United States Patent [19]

Takahashi et al.

[11] Patent Number: 4,870,893

[45] **Date of Patent: * Oct. 3, 1989**

[54] WOBBLE PLATE TYPE COMPRESSOR WITH A DRIVE SHAFT ATTACHED TO A CAM ROTOR AT AN INCLINCATION ANGLE

[75] Inventors: Hareo Takahashi, Takasaki; Hideharu Hatakeyama; Shuzo Kumagai, both of Isesaki, all of Japan

[73] Assignee: Sanden Corporation, Gumma, Japan

[ * ] Notice: The portion of the term of this patent subsequent to Sep. 26, 2006 has been disclaimed.

[21] Appl. No.: 142,694

[22] Filed: Jan. 11, 1988

[30] Foreign Application Priority Data

Jan. 10, 1987 [JP] Japan ..... 62-22631
Jan. 10, 1987 [JP] Japan ..... 62-2635
Jan. 10, 1987 [JP] Japan ..... 62-2636

[51] Int. Cl.[4] ..... F04B 1/26
[52] U.S. Cl. ..... 92/71; 417/209
[58] Field of Search ..... 92/71; 417/269; 74/60; 91/507

[56] References Cited

U.S. PATENT DOCUMENTS 3,552,886 1/1971 Olson, Jr. ..... 417/269
3,712,759 1/1973 Olson, Jr. ..... 417/269
4,042,309 8/1977 Hiraga ..... 417/269
4,283,997 8/1981 Takahashi et al. ..... 417/269 X
4,290,345 9/1981 Hiraga et al. ..... 417/269 X
4,301,716 11/1981 Saegusa et al. ..... 92/71

*Primary Examiner*—William L. Freeh

[57] ABSTRACT

A wobble plate type compressor is disclosed which includes a compressor housing having a plurality of cylinders and a crank chamber adjacent the cylinders therein. A reciprocative piston is slidably fitted within each of the cylinders. A drive mechanism is coupled to the pistons. The drive mechanism includes a drive shaft which is rotatably supported in an opening of a front end plate and extends into the compressor housing. The drive shaft is supported by a radial bearing. The drive shaft is attached on to an end surface of a cam rotor at an inclination angle $\theta_1$ and rotates therewith. The angle $\theta_1$ is predetermined so that under severe operating conditions the interior surface of the radial bearing and the exterior surface of the drive shaft are uniformly contacted with each other to prevent damages due to partial contact. In alternative embodiments, the radial bearing is formed with a conical inner surface to insure uniform contact between it and the exterior surface of the drive shaft.

11 Claims, 6 Drawing Sheets

WOBBLE PLATE TYPE COMPRESSOR WITH A DRIVE SHAFT ATTACHED TO A CAM ROTOR AT AN INCLINCATION ANGLE

BACKGROUND OF THE INVENTION

1. Field of Invention

This invention relates to a wobble plate type compressor for use in an automotive air conditioning system, and more particularly, to an improved cantilever structure for supporting the drive shaft within the compressor housing.

2. Description of the Prior Art

The use of a cantilever structure for supporting the drive shaft in a wobble plate type compressor is well known. For example, this structure is disclosed in U.S. Pat. Nos. 3,552,886 and 3,712,759.

FIG. 1 shows a conventional refrigerant compressor for use, for example, in an automotive air conditioning system. Wobble plate type compressor 1 has a conventional cantilever structure and includes cylindrical compressor housing 2 with front end plate 3 and rear end plate 4 at opposite ends thereof. Rear end plate 4 is in the form of a cylindrical head. Cylinder block 21 is located within compressor housing 2 and crank chamber 22 is formed between the interior surface of compressor housing 2, cylinder block 21, and the interior surface of front end plate 3. Valve plate 5 covers the combined exterior surfaces of compressor housing 2 and cylinder block 21, and cylinder head 4 is attached to compressor housing 2 via bolt 41 extending through valve plate 5. Front end plate 3 includes opening 31 through a central portion thereof and through which drive shaft 6 extends into crank chamber 22.

Drive shaft 6 is rotatably supported within opening 31 of front end plate 3 by radial needle bearing 7. Wedge-shaped cam rotor 8 is fixedly coupled to the end of drive shaft 6 within crank chamber 22. Cam rotor 8 is also supported on the interior surface of front end plate 3 by thrust needle bearing 9. Drive shaft 6 and cam rotor 8 rotate in unison.

Wobble plate 10 is annular and is provided with bevel gear 101 at its central portion. Wobble plate 10 is disposed on inclined surface 81 of cam rotor 8 and is supported by thrust needle bearing 16 therebetween. Supporting member 11 includes shank portion 112 disposed within central bore 211 of cylinder block 21, and bevel gear 111 which engages bevel gear 101 of wobble plate 10. Shank portion 112 includes hollow portion 113. Supporting member 11 nutatably supports wobble plate 10 with spherical element 12, (e.g., a steel ball) disposed between bevel gear 101 and bevel gear 111. A key is located between cylinder block 21 and supporting member 11 to prevent rotational motion of supporting member 11. Adjusting screw 17 is disposed within central bore 211 adjacent the end of shank portion 112. Coil spring 13 is disposed within hollow portion 113 and urges supporting member 11 towards wobble plate 10. The engagement of bevel gear 111 with bevel gear 101 prevents the rotation of wobble plate 10.

A plurality of cylinders 212 are uniformly spaced around the periphery of cylinder block 21. Pistons 14 are slidably fitted within each cylinder 212. Connecting rods 15 connect each piston 14 to the periphery of wobble plate 10 via a ball joint. Discharge chamber 42 is centrally formed within cylinder head 4. Suction chamber 43 has an annular shape and is located within cylinder head 4 at the periphery thereof, around discharge chamber 42. Suction holes 51 are formed through valve plate 5 to link suction chamber 43 with each cylinder 212 and discharge holes 52 are also formed through valve plate 5 to link each cylinder 212 with discharge chamber 42 as well.

A driving source rotates drive shaft 6 and cam rotor 8 via electromagnetic clutch 18 mounted on tubular extension 35 of front end plate 3. Wobble plate 10 nutates without rotating in accordance with the rotational movement of cam rotor 8, and each piston 14 reciprocates within cylinders 212. The recoil strength of coil spring 13 may be adjusted by rotating adjusting screw 17 to securely maintain the relative axial spacing between thrust bearing 9, cam rotor 8, wobble plate 10, bevel gear 101, spherical element 12, and supporting member 11. However, the relevant spacing may change when compressor 1 is operated due to dimensional error in the machining of the elements and due to changing temperature conditions within crank chamber 22.

Wobble plate type compressor 1 is normally used as a refrigerant compressor in an automotive air conditioning system and should be sufficiently durable under normal operating conditions which include periods of operation under severe conditions. However, under severe operating conditions, for example, driving for a long period of time at high temperature, it is possible that the driving parts of the compressor may fail to operate as desired, decreasing the durability of the compressor and causing it to malfunction. It has been determined that compressor malfunction is caused by fragmentation of bits of the exterior surface of drive shaft 6 where it contacts the interior surface of radial needle bearing 7. The fragments damage the other driving parts of the compressor causing it to malfunction. It has also be determined that non-uniform contact between the peripheral end surface of the cam rotor and the thrust bearing located between it and the front end plate may also cause the compressor to malfunction.

FIG. 2 is a developmental view showing the exterior surface of drive shaft 6 within radial bearing 7. (The cylindrical surface has been "unwrapped" and laid flat.) Drive shaft 6 rotates around the center of radial bearing 7 at it rotates on its own longitudinal axis so that the contact surface of drive shaft 6 with radial bearing 7 does not vary. Strong contact, i.e., the greatest loads, and thus fragmentation occurs at area A. Area B indicates additional locations where contact occurs between drive shaft 6 and radial bearing 7. The contact at area B is not as strong so it is not damaged, but area B loses its smooth, polished surface due to the contact. It can be seen that the exterior surface of drive shaft 6 does not uniformly and fully contact the interior surface of radial bearing 7. Fragmentation results from non-uniform contact between the exterior surface of drive shaft 6 and the interior surface of radial bearing 7.

FIG. 3 shows the forces acting on cam rotor 8 and drive shaft 6 during operation of the compressor. The external forces acting on cam rotor 8 include gross gas compression force $F_1$ acting axially at point A due to compression of each piston 14. Point A is located near the connection of connecting rod 15 with wobble plate 10 via the ball joint. The gross gas compression force acts when each piston is at its top dead point, which occurs when the thicker part of cam rotor 8 is adjacent each piston 14. The gross gas compression force acts on inclined surface 81 of cam rotor 8 and therefore includes radial component $F_3$. Additionally, axially urging force $F_2$ acts on cam rotor 8 at a central location. The axially urging force is created due to the recoil strength of coil spring 13 acting on cam rotor 8 via intermediate elements. The urging force also acts on inclined surface 81 of cam rotor 8 and therefore includes radial component $F_4$.

Axial reaction force $F_5$ is created at the contact point, point B, between cam rotor 8 and thrust bearing 9 and balances the axial forces $F_1$ and $F_2$. However, no reaction force is available to balance the combined force provided by the radial component forces $F_3$ and $F_4$ and thus, the radial component forces create a torque causing cam rotor 8 to shift around point $B_1$ within the plane of the paper. As a result, cam rotor 8 is separated from thrust bearing 9 at the side adjacent each piston 14 at its bottom dead point which occurs when the thinner part of cam rotor 8 is adjacent each piston 14. Therefore, the rotational axis of drive shaft 6 is inclined with respect to the longitudinal axis of radial bearing 7, and contact occurs between drive shaft 6 and radial bearing 7 at points C and D. The angle of inclination $\theta$ between drive shaft 6 and radial bearing 7 depends upon the axial length of radial bearing 7 and the clearance in the radial direction between the interior surface of radial bearing 7 and the exterior surface of drive shaft 6.

Radial reaction forces $F_6$ and $F_7$ act on drive shaft 6 from radial bearing 7 in opposite directions at points C and D respectively. Since there is no movement of drive shaft 6 in the radial direction during operation, these forces balance the radial component forces $F_3$ and $F_4$ as follows:

$$F_3+F_4=F_6-F_7$$

Since after cam rotor 8 contacts thrust bearing 9 there is no further rotation around point $B_1$, the moment around point $B_1$ is represented by the following equation:

$$F_3l_1+F_4l_2+F_6l_3-F_1(r_2-r_1)-F_2r_2-F_7l_4=0.$$

where $l_1-l_4$ are displacements measured in the axial direction and $r_1$ and $r_2$ are displacements measured in the radial direction between each force vector and point $B_1$. Each addend is the magnitude of the cross product of the two vectors. However, only one non-zero component remains after the cross product since the force and displacement vectors are perpendicular. $F_5$ is not represented since it acts at point $B_1$.

The magnitude of radial reaction forces $F_6$ and $F_7$ is dependent upon the angle of inclination $\theta$, which is itself dependent upon the axial component of the gross gas pressure. The inclination angle $\theta$ is predetermined to be within a range between 0 and 0.04 degrees when a standard clearance is provided between drive shaft 6 and radial bearing 7. Therefore, the operation of the compressor under a high thermal load causes fragmentation of drive shaft 6 due to the magnitude of the radial reaction forces which create non-uniform contact with radial bearing 7.

SUMMARY OF THE INVENTION

It is an object of this invention to provide a wobble plate type compressor which prevents the occurrence of non-uniform contact between the drive shaft and the radial bearing and between the cam rotor and a thrust bearing between the cam rotor and the front end plate under severe operating conditions, for example, when the air conditioning is operated under a high thermal load to thus increase the durability of the compressor.

This and other objects are achieved in a wobble plate type compressor according to the present invention which includes a compressor housing have a plurality of cylinders and an adjacent crank chamber therein. A reciprocable piston is slidably fitted within each of the cylinders, and is coupled to a wobble plate. A drive mechanism includes a drive shaft which is rotatably supported within a front end plate attached to the compressor housing and which extends within the crank chamber. The drive shaft is supported by a radial bearing within the front end plate and a wedge-shaped cam rotor is attached to the end of the drive shaft. The drive shaft and the cam rotor rotate in unison causing the wobble plate to nutate, reciprocating the pistons within each of their cylinders. The peripheral end surface of the cam rotor adjacent to the interior surface of the front end plate is formed at a predetermined angle with respect to the annular rear surface of the cam rotor. A thrust bearing is located between the peripheral end surface of the cam rotor and the interior end of the front end plate. During operation of the compressor under severe conditions, the peripheral end surface of the cam rotor uniformly contacts the interior surface of the thrust bearing due to the predetermined angle of the end surface to reduce wear on the cam rotor.

Further objects, features and other aspects of this invention will be understood from the following detailed description of the preferred embodiments of this invention with reference to the attached drawings.

BRIEF DESCRIPTION OF THE DRAWINGS

FIG. 9(*b*) is a cross-sectional view showing the assembly of the radial bearing shown in FIG. 9(*a*) within a front end plate according to a second embodiment of this invention.

FIG. 10(*b*) is a cross-sectional view showing the assembly of the radial bearing shown in FIG. 10(*a*) within a front end plate of a compressor in accordance with a third embodiment of this invention.

DETAILED DESCRIPTION OF THE PREFERRED EMBODIMENTS

Figure 1:
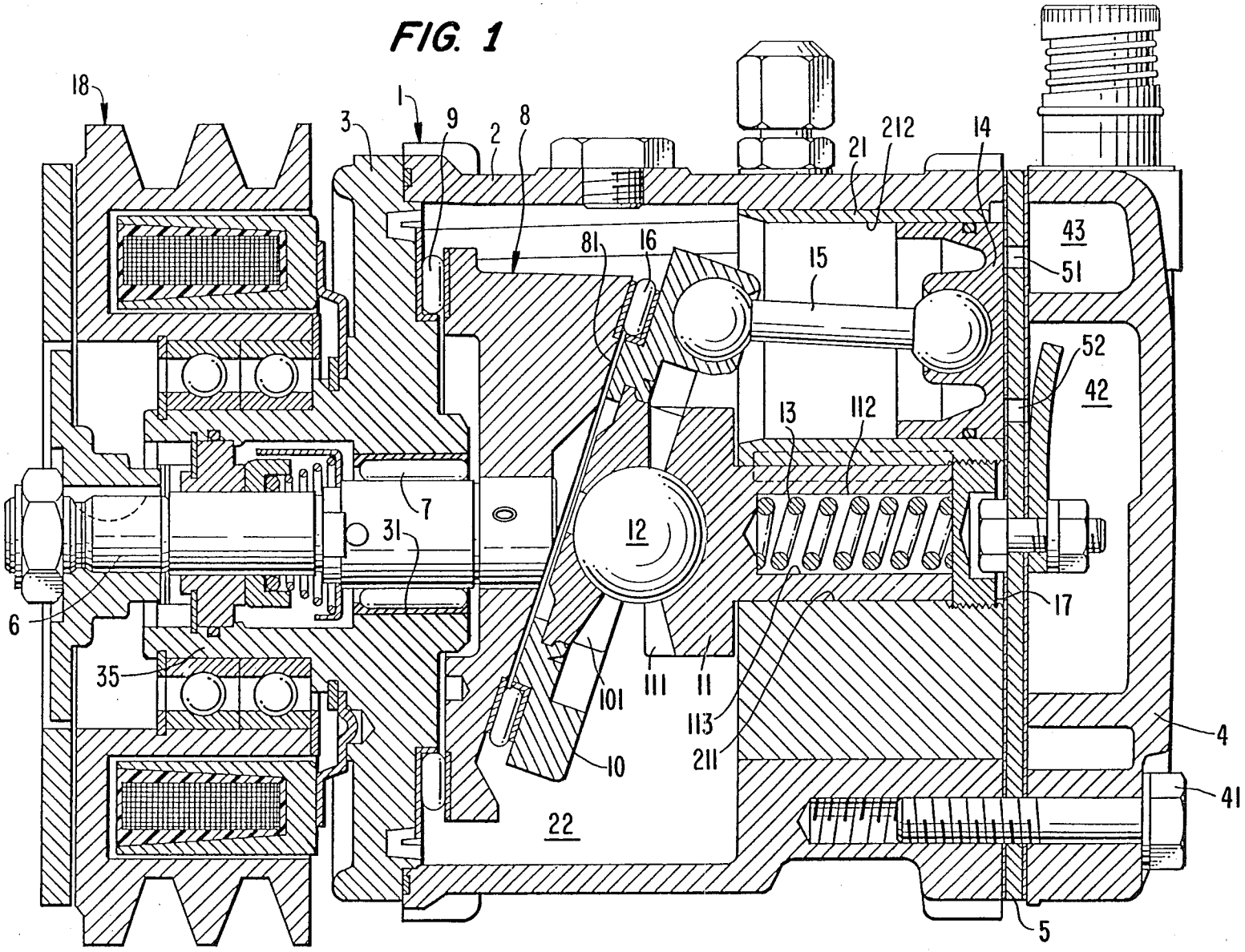
FIG. 1 is a cross-sectional view of a conventional wobble plate type compressor.
Figure 2:
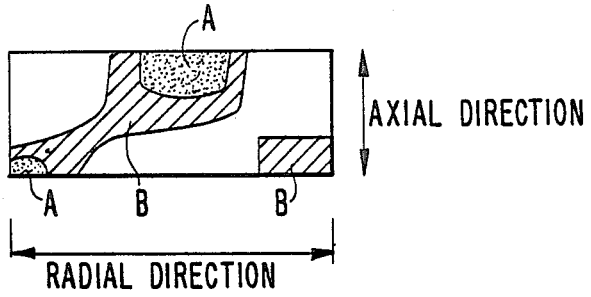
FIG. 2 is a developmental view of the exterior surface of the drive shaft shown in FIG. 1.
Figure 3:
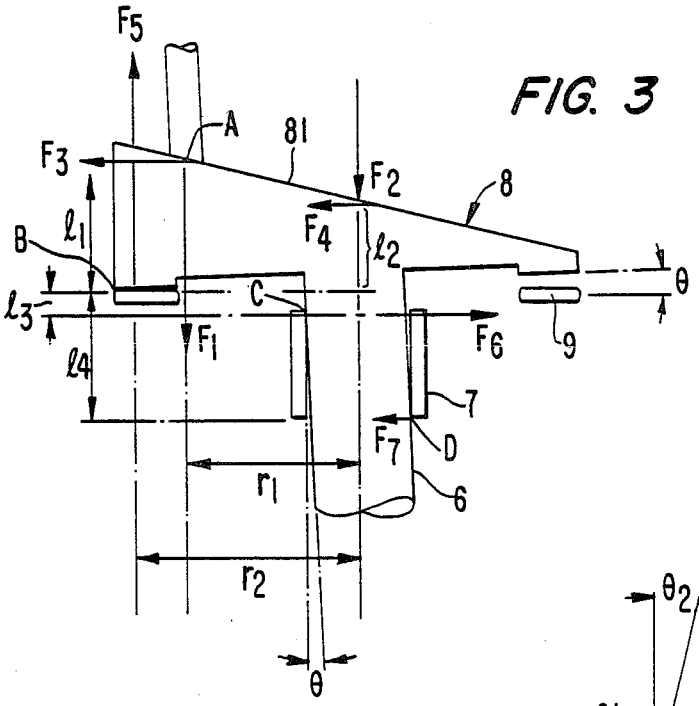
FIG. 3 is an explanatory view showing the relationship between the forces acting on the cam rotor and the drive shaft shown in FIG. 1.
Figure 4:
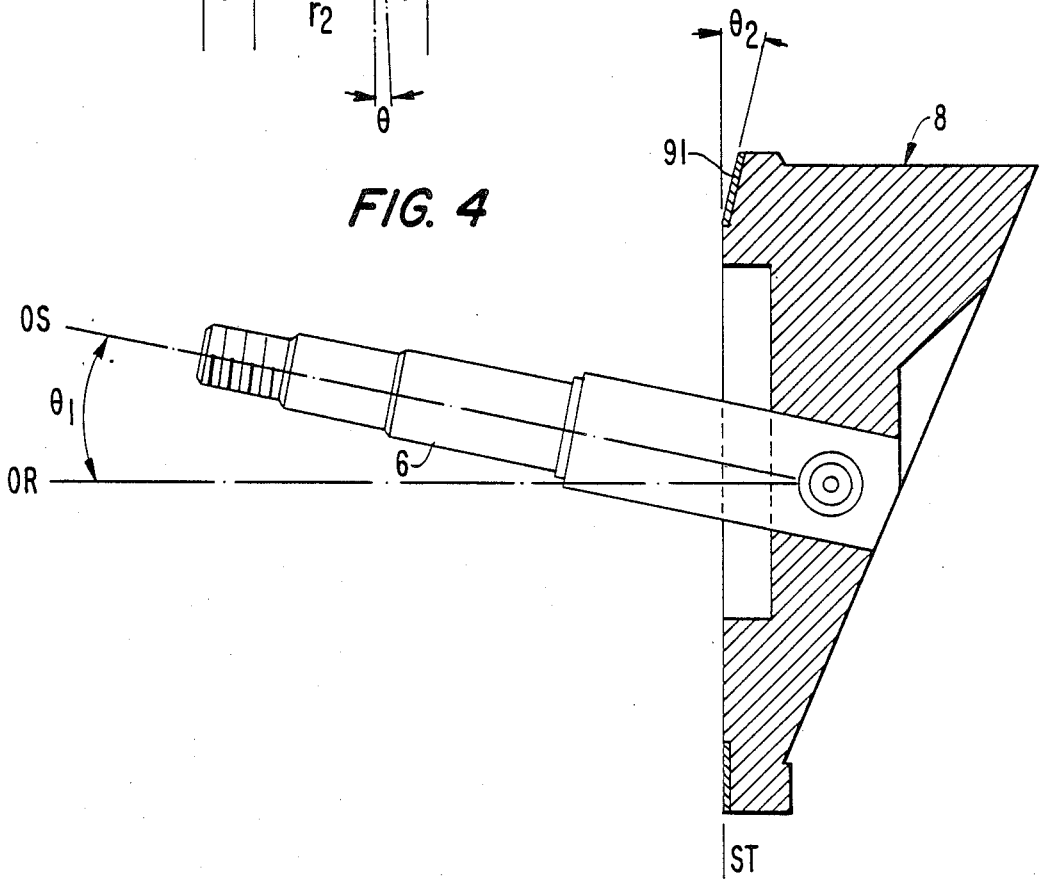
FIG. 4 is a cross-sectional view of a wobble plate type compressor showing the assembly of a cam rotor and a drive shaft in accordance with a first embodiment of this invention.

FIG. 4 shows the construction of a drive shaft and a wedge-shaped cam rotor in accordance with the embodiment of the invention. Reference numerals common to FIG. 1 will be used for common elements. Cam rotor 8 has a wedge-shaped cross section and an annular vertical outer end surface, i.e., facing front end plate 3, defined by line ST. The outer peripheral surface of cam rotor 8 at its thicker side is slanted with respect to the peripheral surface at its thinner side and to line ST. The outer peripheral surface at the thinner side is parallel to line ST. In a conventional compressor, the longitudinal axis of drive shaft 6, indicated as OR, would be perpendicular to line ST. However, in the present invention, drive shaft 6 is assembled with cam rotor 8 so that the longitudial axis of drive shaft 6, indicated as OS, forms an angle $\theta_1$ with perpendicular axis OR. Axis OS is not perpendicular to line ST and drive shaft 6 is inclined towards piston 14 at its top dead point, that is, toward the center of the thicker part of cam rotor 8. The magnitude of angle $\theta_1$ is determined by the following equation:

$$\theta_1 \geqq \tan^{-1}(c/l).$$

c is the clearance between the interior surface of radial bearing 7 and the exterior surface of drive shaft 6 and l is the axial length of radial bearing 7. Plate 91 is disposed between the outer peripheral end surface at the thicker side of cam rotor 8 and radial needle bearing 9 and forms an angle $\theta_2$ with line ST. Angle $\theta_2$ is predetermined so that the value of $\theta_1-\theta_2$ is greater than angle $\phi$ which is further described below.

Figure 5:
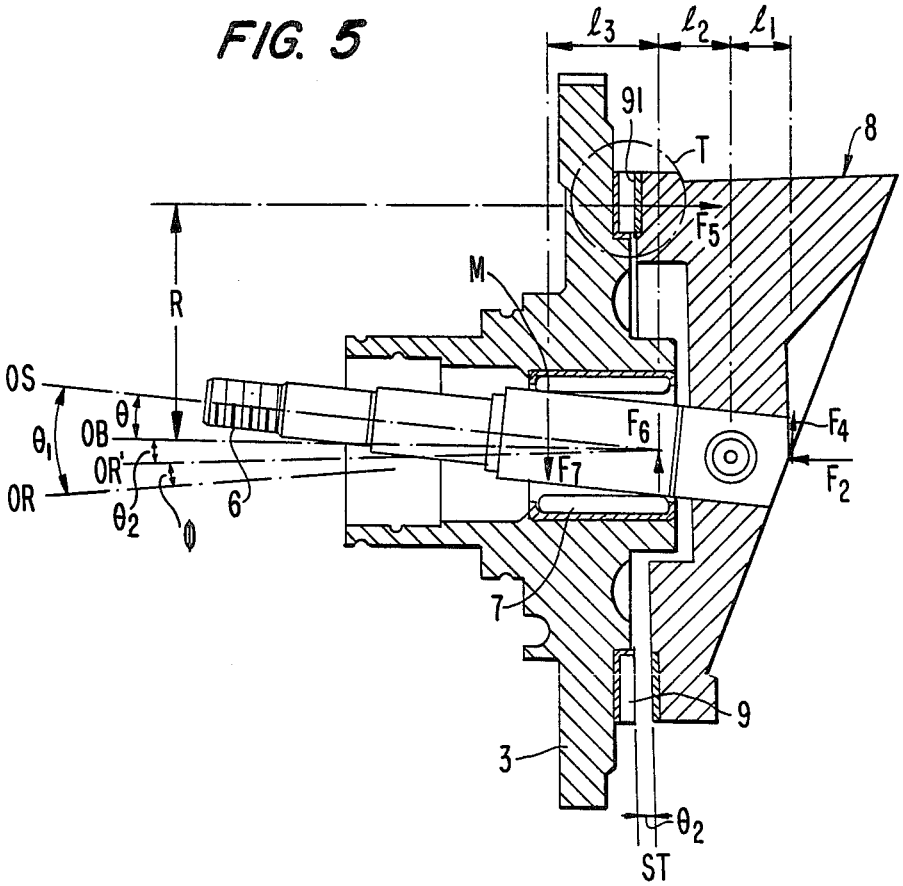
FIG. 5 is a cross-sectional view of part of a wobble plate type compressor including the front end plate, drive shaft, cam rotor, and radial bearing showing the change in relevant angles between various elements caused by the axial urging force when the compressor is not operated according to the first embodiment of this invention.
Figure 6:
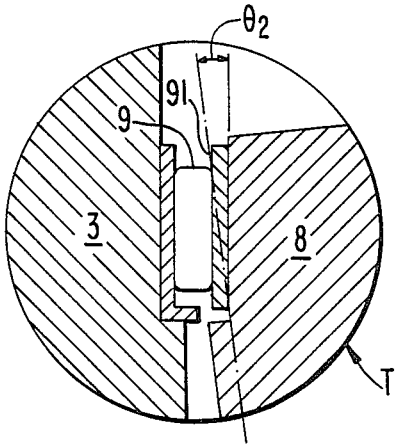
FIG. 6 is an enlarged cross-sectional view of part of the compressor assembly shown in FIG. 5.

FIG. 5 shows cam rotor 8 and drive shaft 6 within front end plate 3 and supported by radial bearing 7 and showing the effect of axial urging force $F_2$ and radial component $F_4$ on the end surface of drive shaft 6. Axial urging force $F_2$ is greater than the force provided by the connection between cam rotor 8 and drive shaft 6, therefore, the lower thinner portion of cam rotor 8 is urged towards the lower inner end surface of front end plate 3. Therefore, axis OR which is perpendicular to line ST shifts upwards in FIG. 5 and is shown as line OR' so that angle $\phi$ is made between axis OR' and axis OR. Additionally, the angle made between longitudinal axis OB of radial bearing 7 and perpendicular axis OR' of cam rotor 8 is $\theta_2$ is identical to the angle $\theta_2$ made between plate 91 and line ST as shown in FIG. 4. Additionally, angle $\theta_2$ is formed between line ST and the interior end surface of front end plate 3.

Angle $\theta$ between axis OS of drive shaft and axis OB of radial bearing 7 is equivalent to $\tan^{-1}(c/l)$. Additionally, since the perpendicular axis OR of cam rotor 8 in FIG. 4 has shifted through angle $\phi$ to line OR' as in FIG. 5, the angle made between the longitudinal axis OS of drive shaft 6 with respect to the perpendicular axis of the cam rotor is shifted through an angle $\phi$. (That is, axial urging force $F_2$ does not shift longitudinal axis OS of drive shaft 6 but does shift the position of cam rotor 8.) Since cam rotor 8 and drive shaft 6 are connected with a strength coefficient k, a restoring force equal to $k\phi$ acts on drive shaft 6. Therefore, since the system is maintained in balance, right rotational moment Ms must also act on drive shaft 6 to counteract the effect of the restoring force.

During non-operation of the compressor under the effect of the axial urging force $F_2$, the balance between the forces acting on the elements of the compressor can be represented by the following equations:

$$F_4+F_6=F_7$$

$$F_2=F_5$$

$$F_5R+F_6l_2-F_4l_1-F_7(l_2+l_3)=0$$

$$Ms=k\phi=F_7(l_2+l_3)-F_6l_2.$$

$F_2$ is the actual urging force and $F_4$ is the radial component thereof. $F_5$ is the reaction force of thrust bearing 9 on the upper thicker portion of cam rotor 8. $F_6$ and $F_7$ are the reaction forces from radial bearing 7 on drive shaft 6 at opposite ends of radial bearing 7. $l_1-l_3$ and R are perpendicular displacements between the associated force vector and the origin of the system which is taken to be the center point of the three concentric circles shown in FIG. 5.

The first two of the above equations represents the balance that is maintained between the forces acting on the compressor elements due to the fact that the elements do not undergo translational motion. The third equation represents the balance of the rotational forces that is maintained after the axial urging force $F_2$ is applied. Each addend in the equation represents the cross-product of a force vector with a displacement vector. The cross-products are simplified since the displacement vector associated with each force vector is perpendicular thereto. The sum of the cross-products equals zero since there is no rotation of any of the elements after force $F_2$ is applied. Finally, the fourth equation represents the balance between the torque provided by reaction forces $F_6$ and $F_7$, that is, the right rotational moment Ms, and the restoring force $k\phi$.

Figure 7:
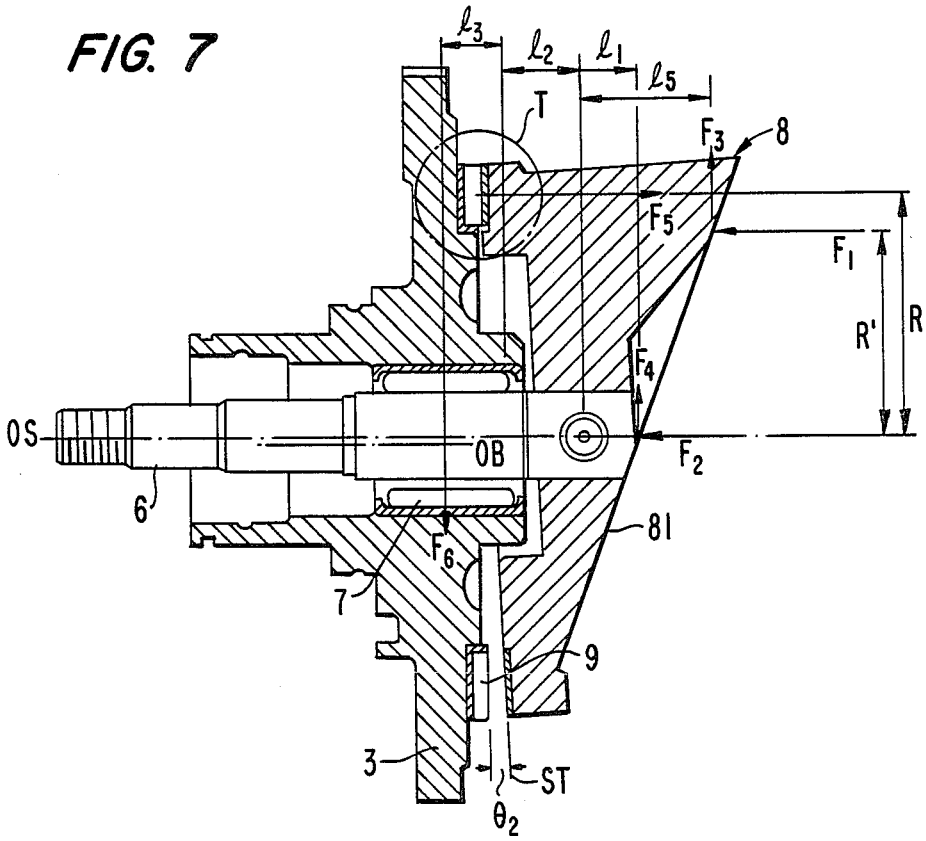
FIG. 7 is a cross-sectional view of the compressor illustrated in FIG. 5 showing the effect of external forces acting on the compressor when it is operating.

FIG. 7 shows the compressor during operation including the effect of gross gas compression force $F_1$ and radial component $F_3$. Radial component force $F_3$ urges the thicker portion of cam rotor 8 toward the upper peripheral surface of front end plate 3 so that a force in addition to that provided by axial urging force $F_2$ in FIG. 5 is also applied to bearing 9. Therefore, drive shaft 6 rotates as well around point M as shown in FIG. 5 which is located at the outer end of radial bearing 7 at the upper surface thereof. Drive shaft 6 rotates with respect to cam rotor 8 due to externally applied force so that the left side of shaft 6 moves towards the thinner side of cam rotor 8. Therefore, longitudinal axis OS of drive shaft 6 becomes parallel though not coincident to longitudinal axis OB of radial bearing 7. Drive shaft 6 is supported on the upper interior surface of radial bearing 7 so that radial bearing 7 and drive shaft 6 are uniformly in contact with each other.

The angle made between the longitudinal axis of drive shaft 6 and line ST of cam rotor 8 is different in FIG. 7 than it is in FIG. 4 or FIG. 5. This angle is shown as $\theta_1$ in both FIGS. 4 and 5 between axes OS and OR. However, as shown in FIG. 5, axis OR has shifted through an angle $\phi$ to become axis OR' due to axial urging force $F_2$. Additionally, axis OS shifts downward to become parallel to axis OB in FIG. 7 due to the effect of gross gas compression force $F_1$. Therefore, the total change in the angle between the longitudinal axis of the drive shaft and the perpendicular axis of cam rotor 8 is equal to $\theta_1-\theta_2$. Since the strength coefficient of the connection between cam rotor 8 and drive shaft 6 is k, the restoring force is equal to $k(\theta_1-\theta_2)$ and acts on drive shaft 6. The right rotational moment Ms, therefore must be equal to $k(\theta_1-\theta_2)$ so that drive shaft 6 is maintained in uniform contact with the upper interior surface of radial bearing 7.

During operation of the compressor, the balance between the force acting on the elements of the compressor can be represented by the following equations:

$$F_3+F_4=F_6$$

$$F_1+F_2=F_5$$

$$F_5R-F_4l_1-F_1R'-F_6(l_2+l_4)=0$$

$$Ms=k(\eta_1\theta_2)=F_6(l_2+l_4)$$

As in the previous set of equations, each addend in the equation represents the cross product of the force vector with a perpendicular displacement vector. The origin in the system is once again the point at the center of the concentric circles. These equations represent the translational and rotational balance of the system after the compressor begins to operate.

Figure 8:
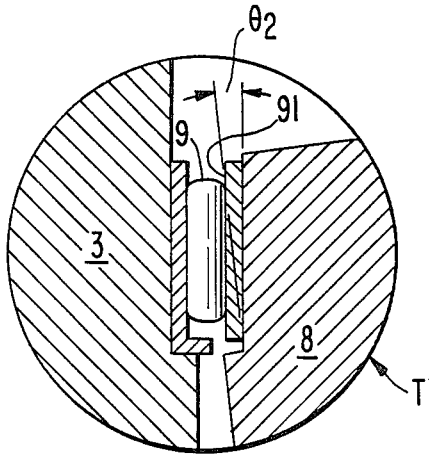
FIG. 8 is an enlarged cross-sectional view of the compressor shown in FIG. 7.

As shown in FIG. 8, plate 91 is disposed on the upper peripheral end surface of cam rotor 8 at an angle of $\theta_2$ with line ST. Therefore, even after the compressor operates, plate 91 uniformly contacts thrust bearing 9 to prevent tearing of the surface.

Figure 9A:
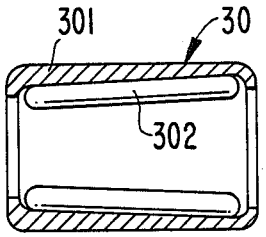
FIG. 9(*a*) is a cross-sectional view a radial bearing of a compressor in accordance with a second embodiment of the invention.
Figure 9B:
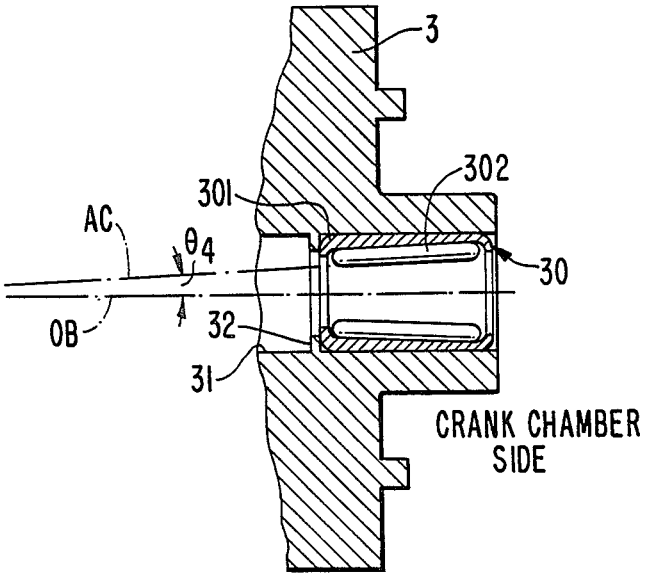

FIG. 9(*a*) shows the construction of a tapered radial bearing utilied to increase the durability of the wobble plate type compressor according to a second embodiment of the present invention. Radial bearing 30 includes cylindrical race 301 and a plurality of needles 302 equiangular disposed along the interior surface of race 301. Race 301 does not have a uniform cross-section and is thicker at one end than the other. Thus, the interior surface of race 301 is tapered and has an annular conical shape. As shown in FIG. 9(*b*), radial bearing 30 is forcibly inserted into central opening 31 of front end plate 3 from the crank chamber side until the thinner portion of thrust race 301 contacts stopper ring 32. After insertion, the interior surface of bearing 30 is tapered so that the large cross-section end is located at the crank chamber side. Angle $\theta_4$ is formed between the longitudinal axis OB of radial bearing 30 and an imaginary extension of the effective conical surface formed by needles 302.

Figure 10A:
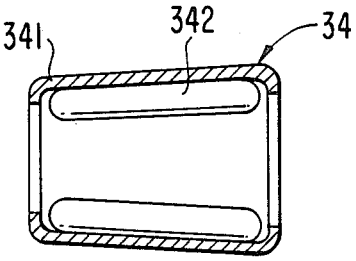
FIG. 10(*a*) is a cross-sectional view of a radial bearing of a compressor in accordance with a third embodiment of this invention.
Figure 10B:
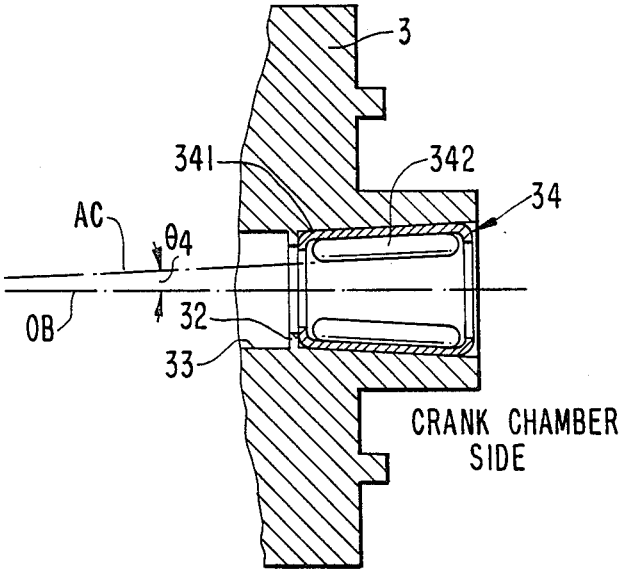

It is also possible that an ordinary (cylindrical) radial bearing may be used to accomplish the same result as in the second embodiment of the present invention. As shown in FIG. 10(*a*), a third embodiment of the invention uses radial bearing 34, which includes thrust race 341 and needles 342 equiangularly disposed around the interior surface thereof. The interior surface of thrust race 341 is not conical. However, as shown in FIG. 10(*b*), front end plate 3 is constructed so that the interior surface of central opening 33 is formed in a conical shape with the inner diameter gradually decreasing from the crank chamber side to the exterior of the compressor. Bearing 34 is forcibly inserted into the conical shaped opening 33 with one end fitted against stopper 32. Therefore, the interior surface of radial bearing 34 is forced to assume an effective conical shape. As in FIGS. 9(*a*) and 9(*b*), the angle between the longitudinal axis OB of radial bearing 34 and an imaginary extension of the effective conical surface formed by needles 342 is angle $\theta_4$.

If the axial length of needles 302 of FIG. 9(*a*) or needles 342 of FIG. 10(*a*) of radial bearings 30 and 34 respectively is l, and the clearance between the exterior surface of drive shaft 6 and the interior surface of the radial bearings at their thinner sides is c, then angle $\theta_1$ formed between longitudinal axis OS of drive shaft 6 and line OR perpendicular to line ST, i.e., before any external forces are applied, is represented by the following inequality:

$$\theta_1 \geqq \tan^{-1}\frac{[(c + l \tan \theta_4)]}{l}$$

Letting $$\tan^{-1}\frac{[(c + l \tan (\theta_4)]}{l},$$

be equal to some angle $\theta_5$, it is desirable that $\theta_1$ be greater than $\theta_5$.

Figure 11:
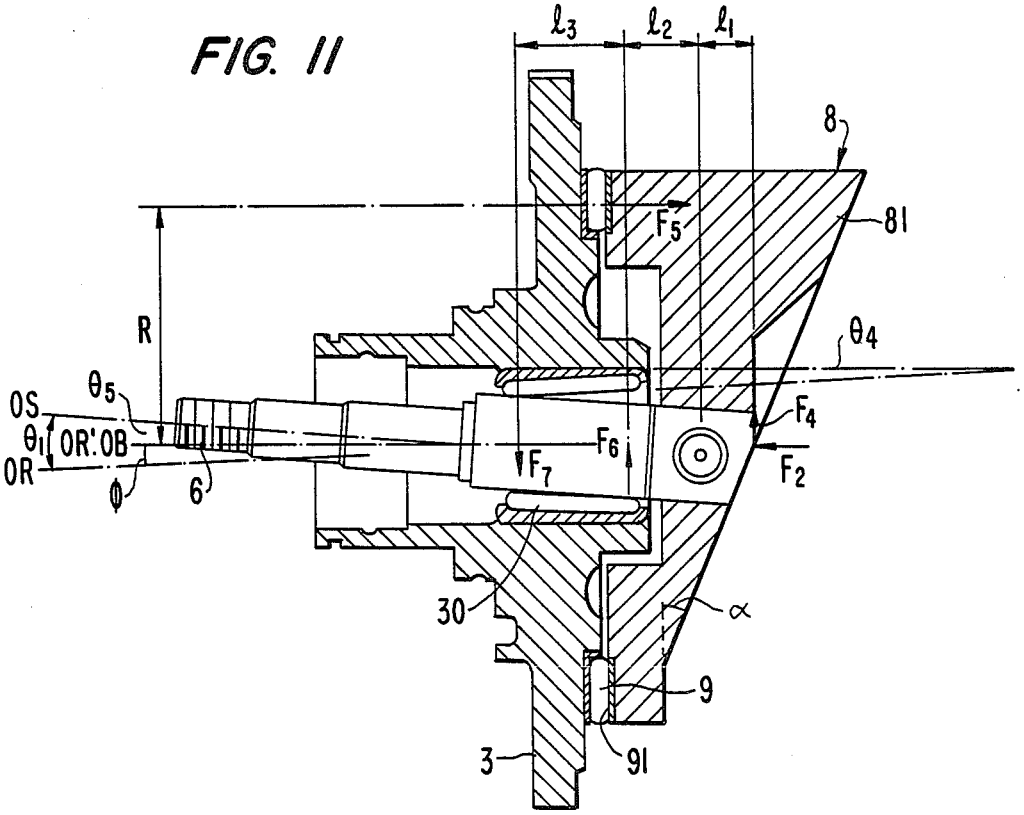
FIG. 11 is a cross-sectional view of a cam rotor, front end plate, drive shaft, and the radial bearing of FIG. 9(*a*) within the front end plate showing the effects of external forces when the compressor is not operating.

FIG. 11 shows the combination of drive shaft 6 and cam rotor 8 with front end plate 3 in either the second or third embodiments. Radial bearing 30 is inserted within front end plate 3 to support drive shaft 6. FIG. 11 also shows the external forces acting on the compressor during non-operation, i.e. axial urging force $F_2$ which urges cam rotor 7 axially. Axial force $F_2$ includes the recoil strength of coil spring 13 which may be varied by adjusting screw 17 to insure uniform contact between the outer peripheral surfaces of cam rotor 8 and thrust bearing 9. Axial urging force $F_2$ urges the thinner side of cam rotor 8 against thrust bearing 9, therefore, perpendicular axis OR of rotor 8 is shifted by an interval of 0 degrees upward and assumes a position shown by line OR' in FIG. 11. Thus $\phi$ represents the relevant angular movements between drive shaft 6 and cam rotor 8 due to axial urging force $F_2$. Line OR' is parallel to longitudinal axis OB of radial bearing 30, and makes an angle $\theta_5$ with longitudinal axis OS of drive shaft 6 as defined above.

If the strength coefficient of the connection between drive shaft 6 and cam rotor 8 is expressed by k, the right-rotational moment Ms must be equal to $k\phi$ which acts on drive shaft 6 as a restoring force. The balance between the forces is represented by the following equations:

$$F_4+F_6=F_7$$

$$F_2=F_5$$

$$F_5R+F_6l_2-F_4l_1-F_7(l_2+l_3)=0$$

$$Ms=K\phi-F_7(l_2+l_3)-F_6l_2$$

The first two equations represent the lack of translational motion of the elements after drive shaft 6 is assembled in front end plate 3 and the adjusting screw is varied to contact rotor 8 with bearing 9. The third equation represents the lack of rotational movement in the plane of the paper around the point at the center of the three concentric circles. The fourth equation represents the balance between the moment provided by the reaction forces $F_6$ and $F_7$ from radial bearing 30 on drive shaft 6 to the restoring force $k\phi$. These equations were derived similarly to the set of four equations derived above. Radial component force $F_4$ acting on inclined surface 81 can be represented by $F_2 \tan \alpha$, where $\alpha$ is the inclination angle of inclined surface 81.

Figure 12:
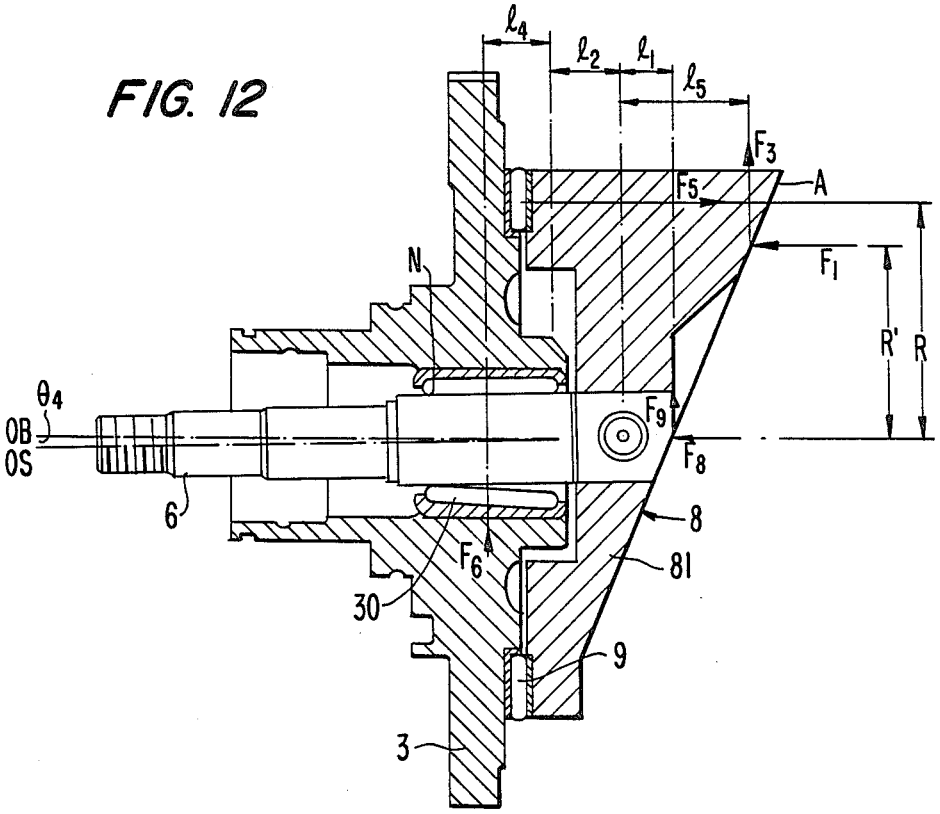
FIG. 12 is a cross-sectional view of the compressor shown in FIG. 9 illustrating the effect of further external forces during operation.

FIG. 12 shows the forces acting on the compressor during operation. The gross gas compression force $F_1$ acts on inclined surface 81 of cam rotor 8 at point A at the top thicker side with radial component $F_3$. Force $F_1$ urges rotor 8 to move translationally upward and not rotationally since there is uniform contact between the periperal end surfaces of rotor 8 and bearing 9. Thus, drive shaft 9 rotates with respect to cam rotor 8. Since the contact between drive shaft 6 and the interior surface of radial bearing 30 is eccentric at point N at the top outer side, drive shaft 6 shifts around point N toward the top dead center side to thereby uniformly contact the interior surface of radial bearing 30. The drive shaft shifts through an angle equal to $\theta_4$ plus $\theta_5$ from its position shown in FIG. 11. Axis OS of drive shaft 6 is parallel to the annular conical surface of radial bearing 30 at the upper side. It should be noted that a gap remains between drive shaft 6 and the lower interior surface of radial bearing 30. Thus, the system is prearranged to provide uniform contact between the exterior surface of drive shaft 6 and the interior surface of radial bearing 30.

Since there is no axial gap between cam rotor 8, thrust bearing 9, wobble plate 10, bevel gear 101, spherical element 12, and bevel gear 111, the axial urging force $F_2$ is expressed as $F_8$ which includes a force which prevents the detachment of the bottom end portion of cam rotor 8 from the peripheral end surface of front end plate 3 during operation. Radial force component $F_4$ becomes radial component $F_9$. When the outer surface of drive shaft 6 uniformly contacts the upper interior surface of radial bearing 30, the balance between the forces and the right-rotational moment can be represented by the following equations:

$$F_3+F_9=F_6$$

$$F_1+F_8=F_5$$

$$F_5R-F_9l_1-F_1R'-F_6(l_2+l_4)=0$$

$$MS=k(\phi+\theta_4+\theta_5)=F_6(l_2+l_4).$$

MS is the right-rotational moment acting on drive shaft 6 due to force $F_6$. $k(\phi+\theta_4+\theta_5)$ is the restoring force provided by the connection between drive shaft 6 and cam motor 8 due to the total change of angle between drive shaft 6 and cam rotor 8 through an angle equal to $(\phi+\theta_4+\theta_5)$. $(\theta_4+\theta_5)$ is the angle between the longitudinal axis OS of drive shaft 6 and the upper interior surface of radial bearing 30 shown in FIG. 9 through which drive shaft 6 rotates due to the effect of the gross gas compression force. $\phi$ is the rotation of drive shaft 6 with respect to cam rotor 8 due to axial urging force $F_8$. Thus $(\phi+\theta_4+\theta_5)$ represents the total angular displacement between cam rotor 8 and drive shaft 6 when all forces are acting.

If the axial urging force $F_2$ is smaller than a predetermined force, and if the bottom portion of cam rotor 8 is not in contact with thrust bearing 9 during operation of the compressor, thrust bearing 9 will uniformly contact cam rotor 8 if the outer peripheral end surface of cam rotor 8 is formed with a predetermined angle $\theta_2$ at the top dead center side.

This invention has been described in detail in connection with the preferred embodiments. The preferred embodiments, however, made, for example, only for this invention and are not restricted thereto. It will be understood by those skilled in the art, that variations and modifications can be easily made within the scope of this invention, as defined by the appended claims.

We claim:

1. In a wobble plate type compressor including a compressor housing having therein a plurality of cylinders and a crank chamber adjacent said cylinders, a reciprocative piston slidably fitted within each of said cylinders, a front end plate with a central opening attached to one end surface of said compressor housing, a drive mechanism coupled to said pistons to reciprocate said pistons within said cylinders, said drive mechanism including a drive shaft rotatably supported by a radial bearing within said central opening of said front end plate and a wedge-shaped cam rotor having an annular outer end surface and being connected to said drive shaft, the improvement comprising having one outer peripheral end surface of said wedge-shaped cam rotor at a predetermined angle $\theta_2$ with said annular outer end surface of said wedge-shaped cam rotor, wherein $\theta_2$ is greater than 0° and lss than or equal to $\theta_1$, wherein $\theta_1$ is greater than or equal to $\tan^{-1}(c/l)$ and wherein c is the clearance between the interior surface of said radial bearing and the exterior surface of said drive shaft at one end of said radial bearing and l is the axial length of said radial bearing.

2. The wobble plate type compressor recited in claim 1 wherein said at least one outer peripheral end surface is the surface at a thicker upper end portion of said cam rotor.

3. The wobble plate type compressor recited in claim 2 wherein said radial bearing comprises a cylindrical race having an interior surface and a plurality of equiangularly spaced needles therein, and the interior surface of said race is tapered and has an inner conical surface.

4. The wobble plate type compressor recited in claim 2 wherein the front end plate opening further comprises an interior surface which includes a conical-shaped surface in which said radial bearing is disposed.

5. The wobble plate type compressor recited in claim 2 wherein said drive shaft is connected to said cam rotor at the angle $\theta_1$ with respect to the annular outer end surface.

6. The wobble plate type compressor as recited in claim 5 wherein said radial bearing has a tapered interior surface and the radial thickness thereof is gradually reduced in a direction from the interior side of the compressor housing toward said front end plate and defined at an angle $\theta_4$ between said interior surface of said radial bearing and the longitudinal axis of said bearing wherein $\theta_4$ is less than or equal to $\theta_1$.

7. The wobble plate type compressor recited in claim 6 wherein $\theta_1$ is defined to be greater than or equal to $$\tan^{-1}\frac{[[\,](c + 1\tan(\theta_4)[\,]]}{1}$$

8. The wobble plate type compressor as recited in claim 2 wherein said radial bearing has a tapered interior surface and the radial thickness thereof is gradually reduced in a direction from the interior side of the compressor housing toward said front end plate and defined at an angle $\theta_4$ between said interior surface of said radial bearing and the longitudinal axis of said bearing wherein $\theta_4$ is less than or equal to $\theta_1$.

9. The wobble plate type compressor recited in claim 5 wherein $\theta_1$ is defined to be greater than or equal to $$\tan^{-1}\frac{[[\,](c + 1\tan(\theta_4)[\,]]}{1}$$

10. The wobble plate type compressor recited in claim 8 wherein $\theta_1$ is defined to be greater than or equal to $$\tan^{-1}\frac{[[\,](c + 1\tan(\theta_4)[\,]]}{1}$$

11. In a wobble plate type compressor including a compressor housing having therein a plurality of cylinders and a crank chamber adjacent said cylinders, a reciprocative piston slidably fitted within each of said cylinders, a front end plate with a central opening attached to one end surface of said compressor housing, a drive mechanism coupled to said pistons to reciproate said pistons within said cylinders, said drive mechanism including a drive shaft rotatably supported by a radial bearing within said central opening of said front end plate and a wedge-shaped cam rotor having an annular outer end surface and being connected to said drive shaft, the improvement comprising having one outer peripheral end surface of said wedge-shaped cam rotor slanted with respect to said annular outer end surface of said wedge-shaped cam rotor at an angle greater than 0° and less than $\tan^{-1}(c/l)$, wherein c is the clearance between the interior surface of said radial bearing and the exterior surface of the drive shaft at one end of said radial bearing before any external forces are applied and l is the axial length of said radial bearing.

* * * * *

UNITED STATES PATENT AND TRADEMARK OFFICE

CERTIFICATE OF CORRECTION

PATENT NO. : 4,870,893

DATED : October 3, 1989

INVENTOR(S) : TAKAHASHI, Hareo; HATAKEYAMA, Hideharu; and KUMAGAI, Shuzo

It is certified that error appears in the above-identified patent and that said Letters Patent is hereby corrected as shown below:

Title page, item [54], line 3, and col. 1, line 3, change "INCLINCATION" to --INCLINATION--.

Title page, item [73], change "Gumma" to --Gunma--.

Col. 7, line 26, change "$Ms = k(\eta_1\theta_2) = F_6(1_2 + 1_4)$" to --$Ms = k(\theta_1 - \theta_2) = F_6(1_2 + 1_4)$--.

Col. 8, line 37, change "7" to --8--.

IN THE CLAIMS:

Col. 11, claim 7, line 3, change "$\tan^{-1} \frac{[[](c+1 \tan(\theta_4)[]]}{1}$" to --$\tan^{-1} \frac{(c + 1 \tan(\theta_4)}{1}$--;

UNITED STATES PATENT AND TRADEMARK OFFICE

CERTIFICATE OF CORRECTION

PATENT NO. : 4,870,893 Page 2 of 2

DATED : October 3, 1989

INVENTOR(S) : TAKAHASHI, Hareo; HATAKEYAMA, Hideharu; and KUMAGAI, Shuzo

It is certified that error appears in the above-identified patent and that said Letters Patent is hereby corrected as shown below:

Col. 11, claim 9, line 20, change "$\tan^{-1} \frac{[[](c+1 \tan(\theta_4)[]]}{1}$" to --$\tan^{-1} \frac{(c + 1 \tan(\theta_4)}{1}$--; and Col. 12, claim 10, line 3, change "$\tan^{-1} \frac{[[](c+1 \tan(\theta_4)[]]}{1}$" to --$\tan^{-1} \frac{(c + 1 \tan(\theta_4)}{1}$--.

Col. 12, claim 11, line 7, change "reciproate" to --reciprocate--.

Signed and Sealed this

Thirteenth Day of July, 1993

*Attest:*

Michael K. Kirk

MICHAEL K. KIRK

*Attesting Officer*

*Acting Commissioner of Patents and Trademarks*